US005942036A

United States Patent [19]

You

[11] Patent Number: 5,942,036

[45] Date of Patent: Aug. 24, 1999

[54] CORRECTION TAPE ROLLER DEVICE

[76] Inventor: Kwang-Ho You, 103-1102 Hyundae Apartment, 1037 Mansu-dong, Namdong-ku Inchun, Kyonggi-do, Rep. of Korea

[21] Appl. No.: 09/076,234

[22] Filed: May 12, 1998

[51] Int. Cl.[6] ..... B05C 1/00

[52] U.S. Cl. ..... 118/257; 118/200; 156/577; 156/579; 400/695; 400/696; 400/700

[58] Field of Search ..... 118/257, 200; 156/577, 579; 400/695, 696, 700

[56] References Cited

U.S. PATENT DOCUMENTS

| | | | |
|---|---|---|---|
| 5,430,904 | 7/1995 | Ono et al. | 118/257 |
| 5,472,560 | 12/1995 | Horng | 156/577 |
| 5,490,898 | 2/1996 | Koyama | 118/257 |
| 5,512,128 | 4/1996 | Manusch et al. | 156/577 |
| 5,556,469 | 9/1996 | Koyama et al. | 118/257 |
| 5,679,156 | 10/1997 | Matsumaru | 118/257 |
| 5,685,944 | 11/1997 | Nose et al. | 156/577 |
| 5,792,263 | 8/1998 | Koyama et al. | 118/257 |

*Primary Examiner*—Laura Edwards
*Attorney, Agent, or Firm*—Michael N. Meller

[57] ABSTRACT

A correction tape roller device which can be easily refilled is provided. It is difficult to shorten the distance between the first and second shafts in the conventional tape roller device of the prior art thereby causing the prior art device to be of a relatively large volume. The correction tape roller device of the present invention uses an inscribed plate and a pinion which reduces the distance between the first and second shafts and improves the an entire spatial use efficiency. A tape guide can be disassembled from a main body of the correction tape roller device, as necessary, and the angle of assembly can be altered, which facilitates correction of typographical errors on paper.

5 Claims, 6 Drawing Sheets

CORRECTION TAPE ROLLER DEVICE

BACKGROUND OF THE INVENTION

1. Field of the Invention

The present invention relates to a correction tape roller device, and more particularly, to a correction tape roller device for covering an incorrect typography on paper with a correction film coated on tape under a dry condition, in which the tape coated with the correction film is pressed over the typographical errors on paper.

2. Description of the Prior Art

A general correction tape roller device includes a predeterminately shaped case having openings, at least one pair of rolls which are rotatably installed in the case, a film-coated tape wound on the rolls, and a tape guide which protrudes outwards via one of the openings, for guiding movement of the film-coated tape and allowing the film-coated tape to be pressed on paper.

A conventional correction tape roller device will be described with reference to FIG. 1.

FIG. 1 is an exploded perspective view showing a conventional correction tape roller device. Referring to FIG. 1, the correction tape roller device 100 includes a case 110. Openings 111 and 112 are formed in the front and rear ends of the case 110, respectively. A latch hole 113 is formed on one side of the upper surface of the case 110. An observatory hole 114 for ascertaining a remaining state of the film-coated tape is formed on one side of one lateral surface thereof. Also, a clip 115 for allowing the case to be put into a pocket is formed on one side of the other lateral surface thereof. The case 110 accommodates the film-coated tape and the various components therein to protect them from being damaged. Also, the case 110 and the various components accommodated in the case 110 can be easily disassembled.

As shown in FIG. 1, a main body 130 which is combined in the case 110 is shown downwards the case 110. The main body 130 is provided with a tape guide 131 for guiding movement of the film-coated tape 120. The tape guide 131 protrudes long forward the main body 130. The tape guide 131 is inserted into the rear opening 112 of the case 110 and protrudes outward the case 110 via the front opening 111. Also, the tape guide 131 plays a role of pressing the film-coated tape 120 against paper. The tape guide 131 is made of a material of excellent elasticity. A fitting unit 132 is shown in front of the tape guide 131. The fitting unit 132 includes a through hole 133 via which the tape guide 131 can be inserted. The fitting unit 132 is combined with the tape guide 131 to play a role of preventing the film-coated tape 120 from drifting away from the tape guide 131. A roll mounting portion 134 is formed in the rear end of the tape guide 131. The roll mounting portion 134 is substantially circular. An elastic arm 135 is formed surrounding the main body 130, around the roll mounting portion 134. The elastic arm 135 enables the main body 130 to be easily detached from or attached to the case 110, which includes a latch 136 which is engaged with the latch hole 113.

A first roll 140 and a second roll 150 are shown in either end of the main body 130, respectively. The first and second rolls 140 and 150 rotate in both lateral sides of the roll mounting portion 134, respectively. As shown in FIG. 1, a first gear 160 is formed in one side of the first roll 140, via which a first shaft 162 is provided. The first roll 140 is mounted via the first shaft 162. An unused film-coated tape 120 is wound around the first roll 140. Also, a second shaft 172 is provided in the roll mounting portion 134. The second roll 150 is rotatably installed in the other lateral side of the roll mounting portion 134 via the second shaft 172. A second gear 170 is engaged with the first gear 160 in the opposed side end. Empty tape 122 after use is wounded on the second roll 150.

That is, the first gear 160 and the first roll 140 are assembled around the first shaft 162 and the second roll 150 and the second gear 170 are assembled around the second shaft 172. Then, the film-coated tape 120 is wound around the end of the tape guide 131, and then the fitting unit 132 is fitted into the tape guide 131. After that, the main body 130 is inserted into the case 110, at the state Where the elastic arm 135 of the main body 130 is slightly pressed. As a result, the latch 136 is engaged with the latch hole 113, which completes assembly of the main body 130 with the case 110. In this state. the end of the tape guide 131 protrudes forward the front opening 111, which allows the correction tape roller device 100 to be used. In the case when the correction tape roller device is not used, if the front end is pulled forwards, the correction tape roller device moves as shown in the drawing, to thus protect the film-coated tape 120 from being damaged.

In the above conventional correction tape roller device 100, since the distance between the first and second shafts 162 and 172 should be maintained, the main body 130 and the case 110 should be of relatively great volume. Also, since the tape guide 131 is attached to the main body 130 integrally, if the whole main body 130 is made of a relatively expensive material of good quality, production cost becomes high. It is also a defect that a correction work is possible only one direction.

SUMMARY OF THE INVENTION

To solve the above problems, it is an object of the present invention to provide a correction tape roller device in which a spatial utility can be heightened to thereby reduce the size of the device, a main body can be allowed to be made of a different material from that of a tape guide, and a holding direction can be changed at a user desired posture.

To accomplish the above object of the present invention, there is provided a correction tape roller device having first and second rolls around which predetermined tape is wound, the correction tape roller device comprising: a predeterminately shaped case in which at least one side is opened via a predetermined sized opening; a main body having a tape guide which can protrude via the opening and a roll mounting portion formed in at least one side thereof; an inscribed plate having an inner circumferential surface of a predetermined radius, which is connected with the first roll and rotatably installed in one side of the roll mounting portion; and a pinion which is connected with the second roll and rotatably installed in the roll mounting portion, and which is engaged with the inscribed plate and rotates in the same direction as that of the inscribed plate.

An O-shaped ring having a large frictional force is preferably installed in at least one side among the inscribed plate and the pinion, or gear teeth are preferably formed in the inner circumferential surface of the inscribed plate and the outer circumferential surface of the pinion, respectively.

The case is preferably opened via the openings in both ends, on the upper surface of which first and second through holes are formed in parallel with each other. An elastic arm on which a first protrusion to be engaged with the first through hole and a second protrusion to be engaged with the second through hole are formed is preferably formed on the main body, to thereby enable the main body to move by a predetermined distance, and to be detached from or attached to the case.

An inner space is preferably formed on at least one side around the roll mounting portion. At least one side of the inscribed plate is preferably opened in the other surface via the through hole. The pinion is preferably installed in the other surface thereof.

A first combined portion made of a groove or protrusion of a cross (+) shape is preferably formed in the end of the tape guide, and a second combined portion made of a protrusion or groove of a cross (+) shape is preferably formed in the main body, thus enabling the tape guide to be detached from or attached to the main body.

DETAILED DESCRIPTION OF THE INVENTION

Figure 1:
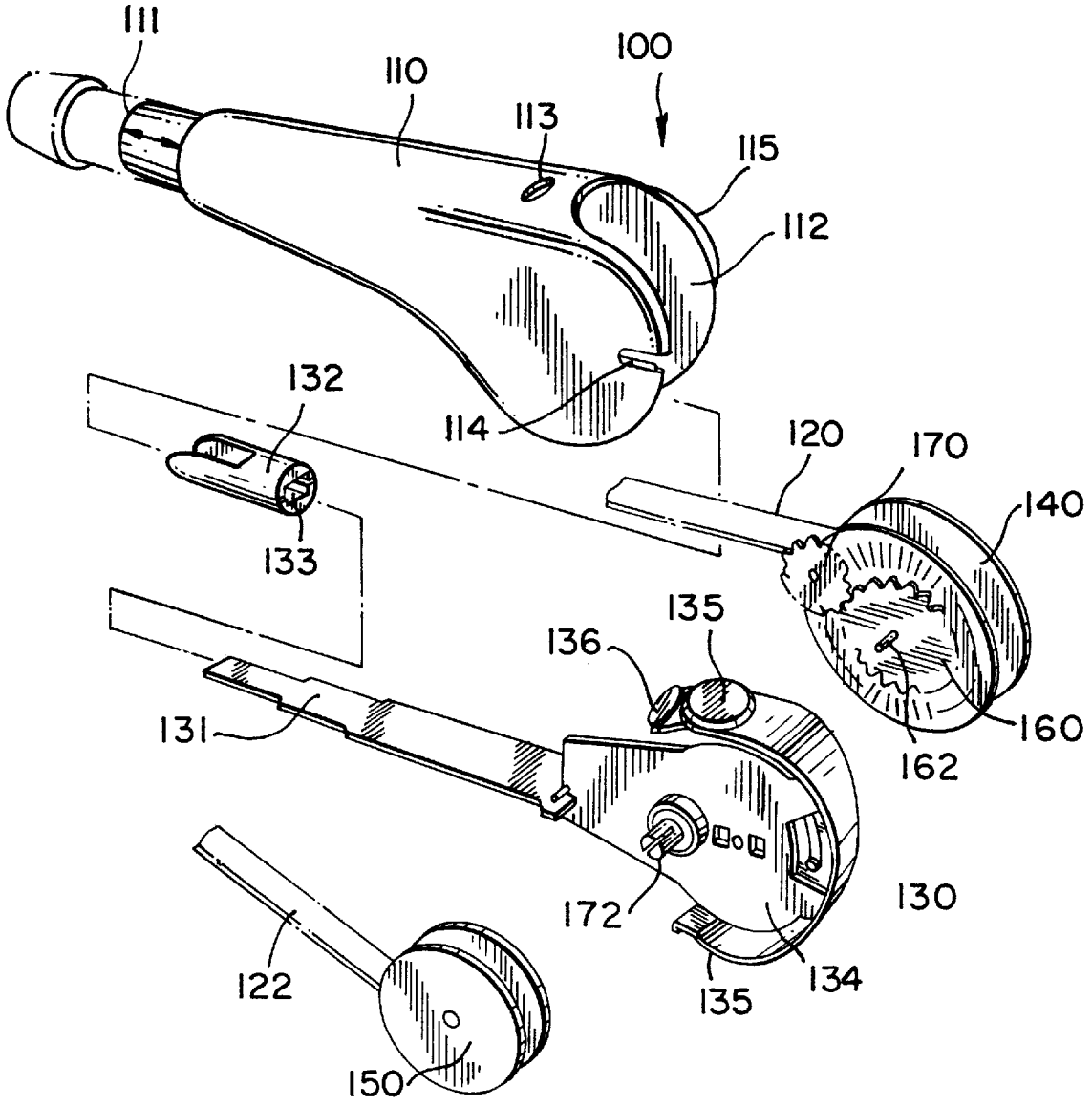
FIG. 1 is an exploded perspective view showing a conventional correction tape roller device.

A preferred embodiment of the present invention will be described in detail with reference to the accompanying drawings.

As shown in FIGS. 2 through 5, a correction tape roller device 200 according to the present invention includes a case 210. Openings 211 and 212 are formed in the front and rear ends of the case 210, respectively, which communicate with each other. A first latch hole 213 and a second latch hole 214 are formed in parallel on one side of the upper surface of the case 210. Also, a clip 215 for allowing the case to be put into a pocket is formed on one side of the other lateral surface thereof.

As shown in the drawings, the correction tape roller device 200 according to the present invention includes a main body 230 having a predetermined shape. The main body 230 is provided with a tape guide 231 which is inserted into the rear opening 212 of the case 210 and protrudes outward the case 210 via the front opening 211. The tape guide 231 includes a first combined portion 232 which enables the tape guide to be detached from or attached to the main body 230. The first combined portion 232 may be made of a groove or protrusion of a cross (+) shape which is preferably formed in the end of the tape guide 231. Accordingly, the tape guide 231 can be detached from or attached to the main body 230. Also, the tape guide 231 can be attached to the main body 230, in the state where the tape guide 231 is rotated by 90° which can allow a user to hold the case 210 at the convenient posture in use.

Meanwhile, as shown in the drawings, a second combined portion 233 is formed in one side of the main body 230. The second combined portion 233 may be formed in the form corresponding to that of the first combined portion 232. A roll mounting portion 234 is formed in the main body 230, in which the roll mounting portion 234 is substantially circular. An inner space 235 is formed around the roll mounting portion 234 in the main body 230. The inner space 235 is necessary in the case when an inscribed plate 240 and a pinion 250 are formed in both ends of the roll mounting portion 234, respectively. Otherwise, the inner space 235 does not need to exist therein.

Figure 3:
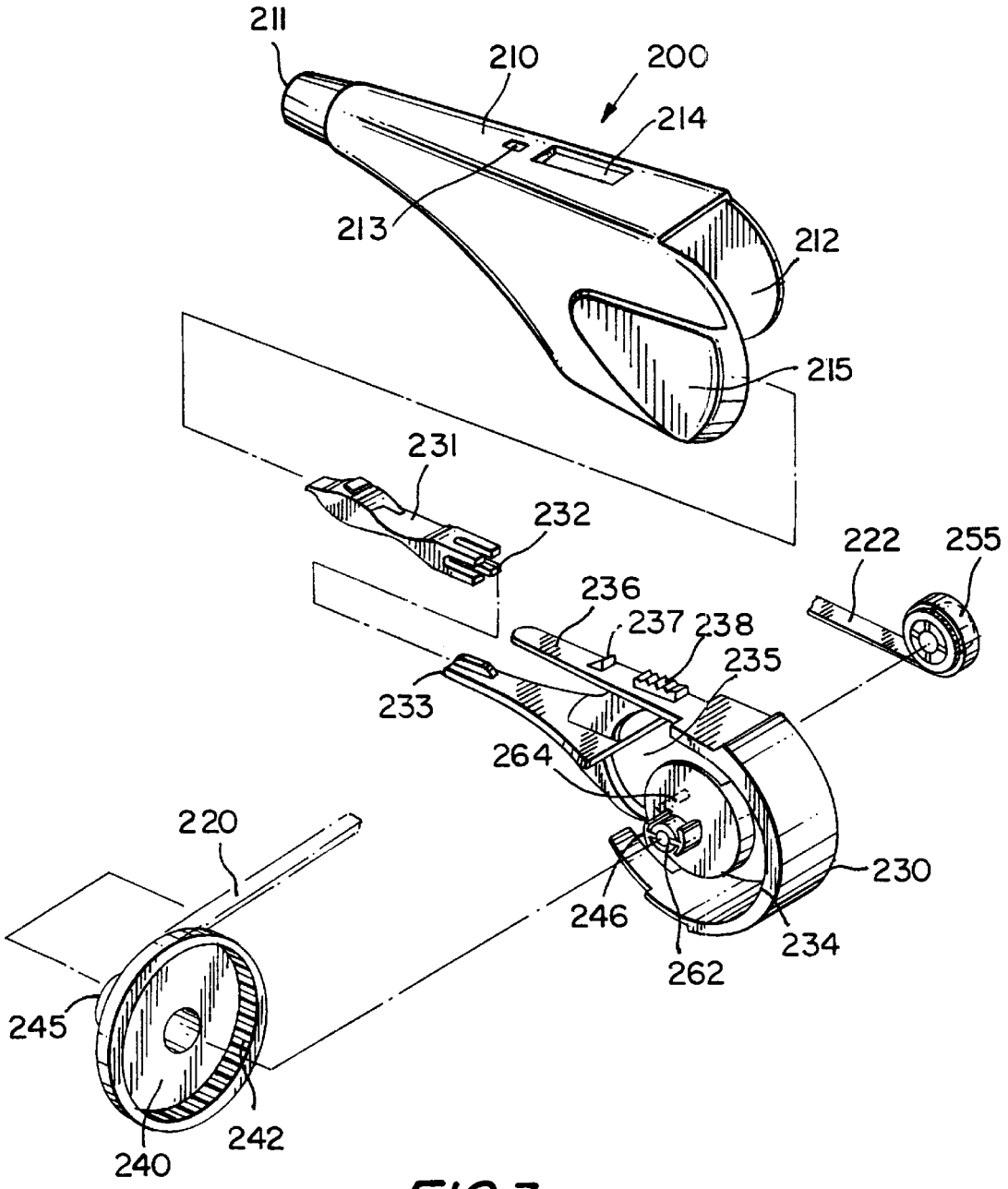
FIG. 3 is an exploded perspective view of the correction tape roller device of FIG. 2.
Figure 4:
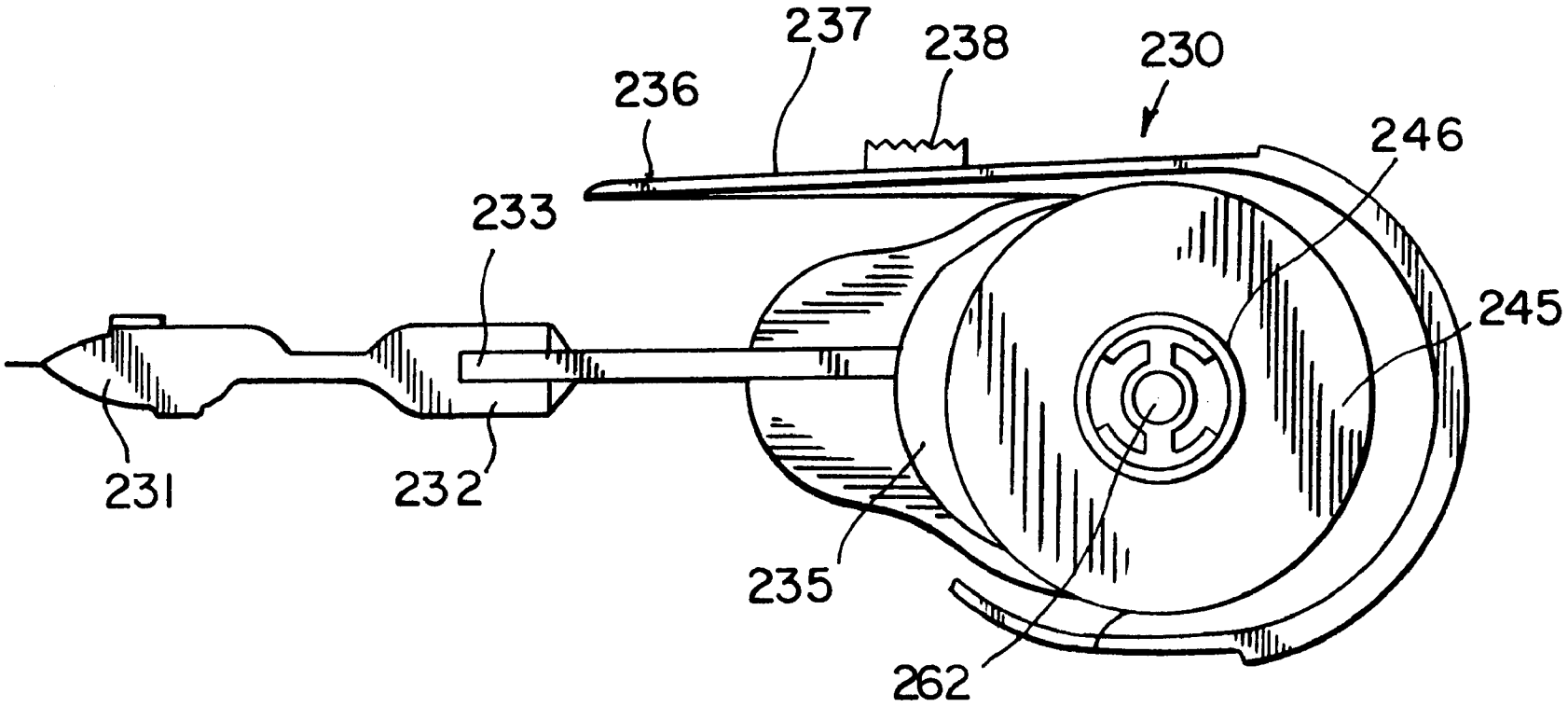
FIG. 4 is a front view of the main body in which first and second rolls are connected with each other.
Figure 5:
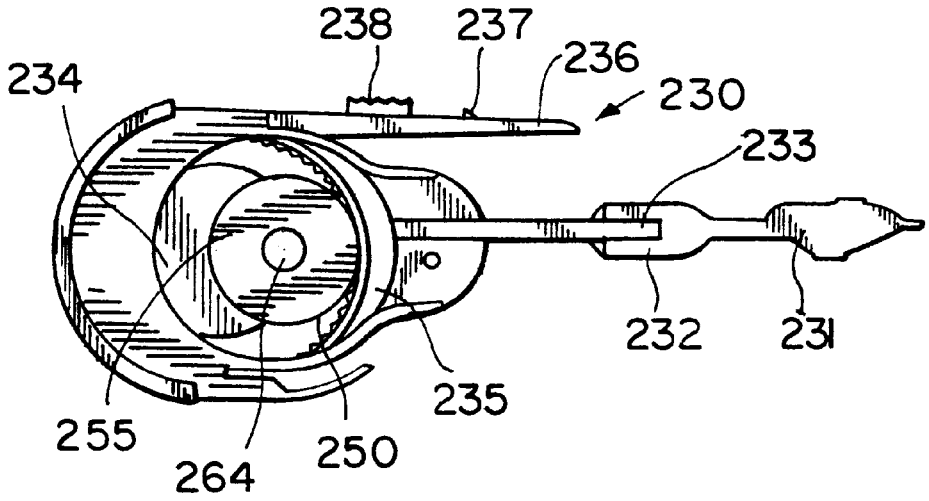
FIG. 5 is a rear view of the main body in which first and second rolls are connected with each other.

As can be seen from FIGS. 3 through 5, an elastic arm 236 is formed in the outer side of the roll mounting portion 234, in which the elastic arm 236 is disposed in substantially parallel with the tape guide 231. The elastic arm 236 enables the main body 230 to be easily detached from or attached to the case 210. A first protrusion 237 and a second protrusion 238 are installed spaced by a predetermined distance, on the upper surface of the elastic arm 236. Here, the first protrusion 237 is engaged with the first latch hole 213, to thereby enable the end of the tape guide 231 to protrude outward the opening 211. The second protrusion 238 is engaged with the second latch hole 214, which can allow the main body 230 to be detached from or attached to the case 210, and allow the first protrusion 237 to be detached from the first latch hole 213 and to be engaged with the second latch hole 214. As a result, the main body 230 moves back so that the end of the tape guide 231 can be hidden into the case 210. A first shaft 262 is provided in one side of the roll mounting portion 234, and a second shaft 264 is provided in the other side thereof, spaced by a predetermined distance from the first shaft 262. The distance between the first and second shafts 262 and 264 can be accomplished much shorter than the conventional art, to thereby improve a spatial use efficiency. In other words, when compared with the conventional art, the correction tape roller device 200 according to the present invention which is the same size as that of the conventional art, can accommodate a relatively large amount of a film-coated tape 220 therein.

Figure 7:
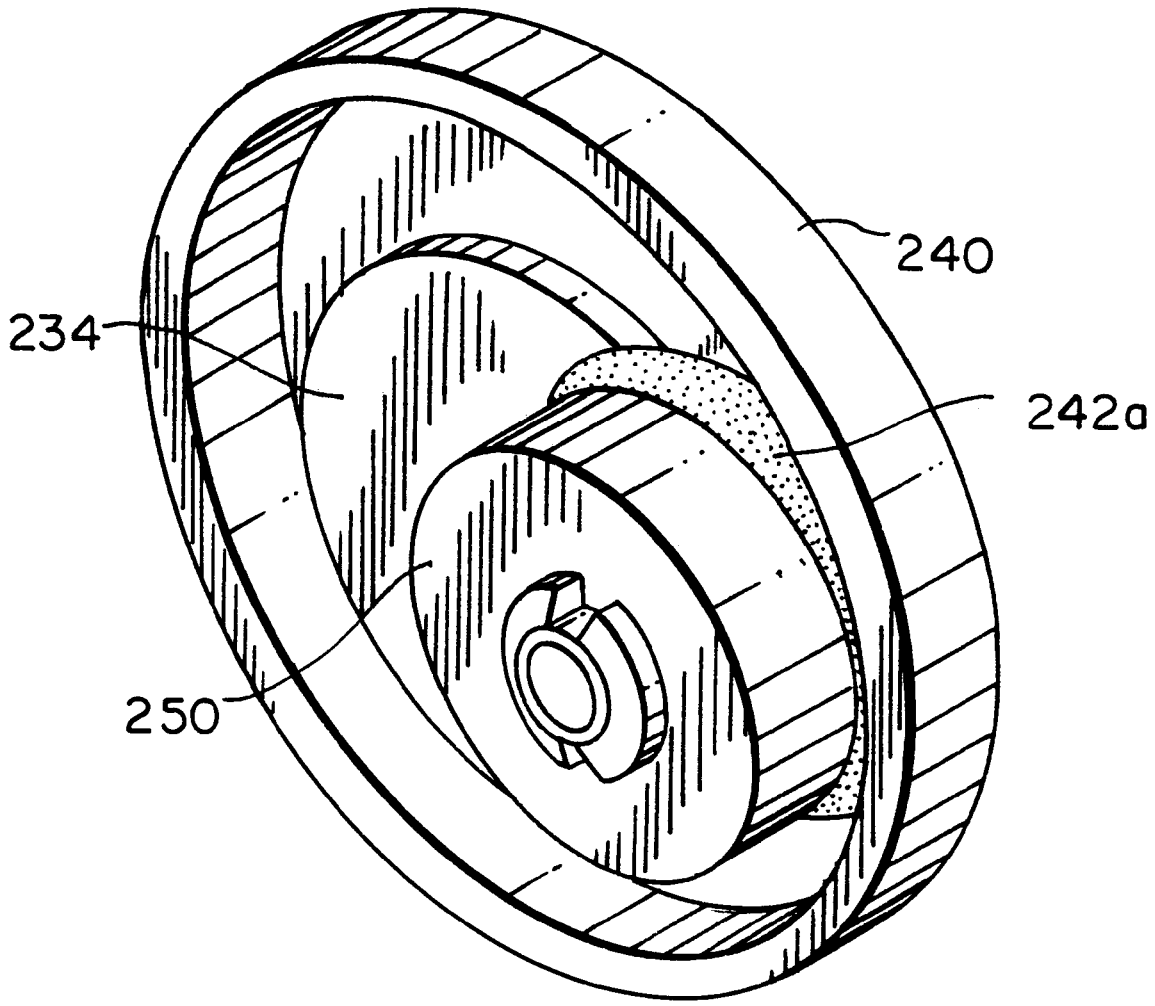
FIG. 7 shows the state where an O-shaped ring is installed in the pinion.

The correction tape roller device 200 according to the present invention includes a first roll 245 around which an unused film-coated tape 220 is wound and a second roll 255 around which an empty tape 222 after use is wound. The inscribed plate 240 having an inner circumferential surface of a predetermined radius is connected with the first roll 245 and the pinion 250 is connected with the second roll 255. Gear teeth may be formed in the inner circumferential surface of the inscribed plate 240 and the outer circumferential surface of the pinion 250, respectively. Alternatively, as shown in FIG. 7, an O-shaped ring 242*a* may be installed in both ends of the inner circumferential surface of the inscribed plate 240 and the outer circumferential surface of the pinion 250, respectively. The inscribed plate 240 is preferably installed into the first shaft 262 using an auxiliary member 246.

That is, one side of the inscribed plate 240 combined with the first shaft 262 protrudes via the inner space 235 toward the opposing side. while the pinion 250 combined with the second shaft 264 is engaged with the inscribed plate 240. This can be seen from FIG. 5 more apparently.

Alternatively, the inscribed plate 240 may be rotatably installed in one side of the roll mounting portion 234 via the first shaft 262, and the pinion 250 may be installed via a second shaft which protrudes in both sides in order to be engaged with the inscribed plate 240 between the inscribed plate 240 and the roll mounting portion 234. In this case, the inner space 235 is not necessary.

Figure 2:
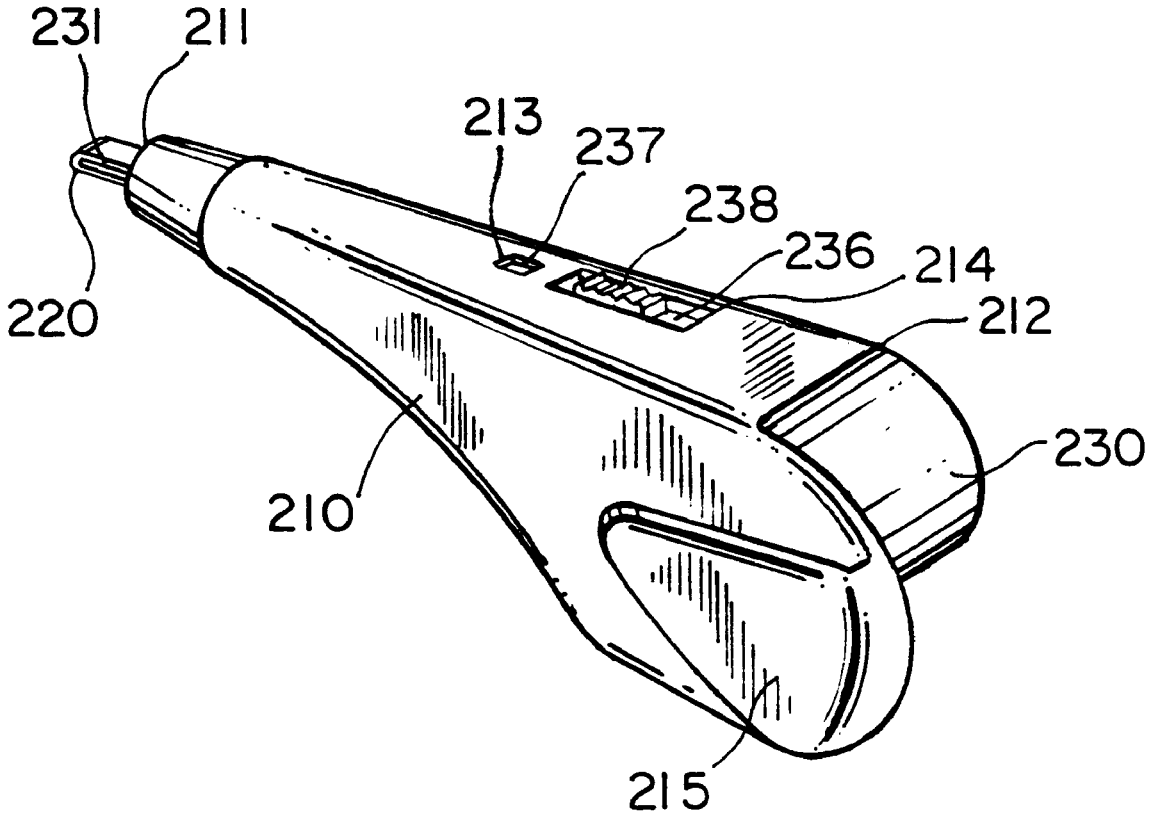
FIG. 2 is a perspective view of a correction tape roller device according to the present invention.

That is, the first shaft 262 is combined with the inscribed plate 240 and the second shaft 264 is combined with the pinion 250. Then, the tape guide 231 is assembled with the second combined portion 233. After that, the main body 230 is inserted into the case 210 via the rear opening 212, at the state where the bottom side and the upper elastic arm 236 of the main body 230 are slightly pressed. As a result, the first protrusion 237 is engaged with the first latch hole 213 and the second protrusion 238 is engaged with the second latch hole 214, which completes assembly of the correction tape roller device 200 as shown in FIG. 2. In this state, the end of the tape guide 231 is pressingly moved over an error portion on paper, which allows the correction tape roller device 100 to be used for correction. In the case when the correction tape roller device 200 is not used, if the main body 230 is pulled and moved back with the elastic arm 236 pressed, the first protrusion 237 is detached from the first latch hole 213 and then engaged with the second latch hole 214. Accordingly, the end of the tape guide 231 is also hidden into the case 210.

Alternatively, an unused film-coated tape 220 may be wound around the second roll 255 and an empty tape 222 after use may be wound around the first roll 245.

In the case when the film-coated tape 220 after completion of use is replaced by a new one, the elastic arm 236 is pulled back at the state of being further pressed, in which case the main body 230 is completely detached from the case 210.

Then, the first and second rolls 245 and 255 can be replaced by new ones. In the case when the posture holding the case 210 is changed during correction, the user makes the tape guide 231 detached from the main body 230 and rotated by 90° and then assembles the tape guise 231 with the main body 230.

Figure 6:
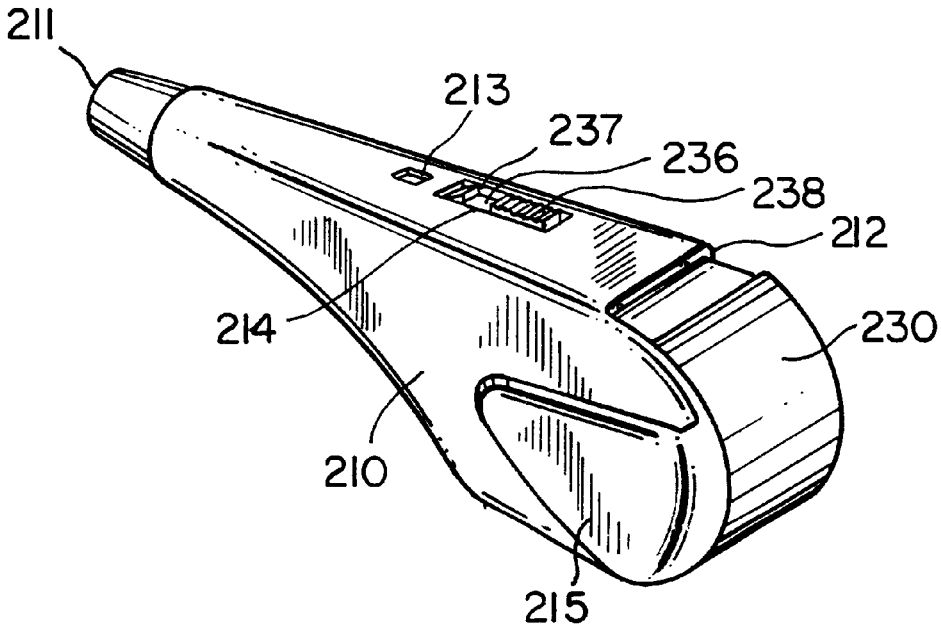
FIG. 6 is a perspective view of the state where the main body is moved to the rear direction to hide the end of the tape guide into the case.

FIG. 6 is a perspective view of the state where the main body is moved to the rear direction to hide the end of the tape guide into the case. In the state shown in FIG. 2, if the second protrusion 238 of the elastic arm 236 is slightly pressed and then pulled back, the first protrusion 237 is detached from the first latch hole 213 and moved into the second latch hole 214. At the same time, the main body 230 is moved back and becomes the state shown in FIG. 6. That is, the end of the tape guide 231 and the film-coated tape 220 wound thereon are hidden into the case 210 via the opening 211, to thereby protect the film-coated tape 220 from being polluted by foreign matter such as dust. Also, if the second protrusion 238 is pushed forward, the main body 230 moves forward and the end of the tape guide 231 protrudes forward the opening 211.

FIG. 7 shows the state where an O-shaped ring is installed in the pinion.

As shown in FIG. 7, an O-shaped ring 242*a* is provided in the outer circumferential surface of the pinion 250 engaged with the inscribed plate 240, to thereby transmit a rotation force by the friction forces formed between the inscribed plate and pinion. Alternatively, the O-shaped ring 242*a* may be installed only in the inner circumferential surface of the inscribed plate 240, or may be installed in both the outer circumferential surface of the pinion 250 and the inner circumferential surface of the inscribed plate 240. Also, the pinion 250 is preferably made of rubber. However, the pinion 250 may be made of a material having a large frictional force instead of rubber. When the O-shaped ring 242*a* is used as shown in FIG. 7, an improper rotational ratio may occur between the first and second rolls when the gear teeth 242 are formed which can be mitigated.

As described above, the correction tape roller device according to the present invention, uses an inscribed plate and a pinion gear, to thereby reduce an inter-shaft distance. As a result, the size of the device can be reduced. Also, a tape guide can be detached from a main body and the tape guide may be made of a different material from that of the main body. Thus, production cost can be reduced. Also, the posture of holding the correction tape roller device can be altered according to user taste.

What is claimed is:

1. A correction tape roller device comprising a predeterminately shaped case having one end thereof opened via a predetermined sized opening and having at least two sides;

a main body having a tape guide which can protrude via the opening in said case and a roll mounting portion, said roll mounting portion including a first roll about which unused correction tape is wound and a second roll around which tape after use is wound;

an inscribed plate having an inner circumferential surface of a predetermined radius, connected to said first roll and rotatably installed in said one side of the roll mounting portion for rotation in a given direction; and a pinion connected to said second roll and being rotatably installed in another side of the roll mounting portion in engagement with the inscribed plate for rotation in the same direction as that of the inscribed plate.

2. The correction tape roller device according to claim 1, wherein an O-shaped ring having a large frictional force is located between the inscribed plate and the pinion.

3. The correction tape roller device according to claim 1, wherein gear teeth are formed in the inner circumferential surface of the inscribed plate and the outer circumferential surface of the pinion, respectively.

4. The correction tape roller device according to claim 1, wherein said case is opened at each opposite end thereof and includes first and second throughholes located on one surface with said throughholes in tandem with one another and an elastic arm having a first protrusion engaged with the first throughhole and a second protrusion engaged with the second throughhole formed on said main body, to thereby enable the main body to move back and forth by a predetermined distance, and to be detached from or attached to the case.

5. The correction tape roller device according to claim 1 further comprising an inner space formed on the roll mounting portion on said one side of said main body with said inscribed plate being open via the inner space, a first combined portion having a cross (+) shape formed in the end of the tape guide, and a second combined portion having a cross (+) shape formed in the main body for coupling the main body to the tape guide so as to enable the tape guide to be rotated by a predetermined angle and to be detached from or attached to the main body.

* * * * *